United States Patent [19]

Watanabe

[11] 4,210,114

[45] Jul. 1, 1980

[54] AIR-FUEL RATIO CONTROL APPARATUS FOR AN INTERNAL COMBUSTION

[75] Inventor: Haruo Watanabe, Toyota, Japan

[73] Assignee: Toyota Jidosha Kogyo Kabushiki Kaisha, Toyota, Japan

[21] Appl. No.: 866,800

[22] Filed: Jan. 3, 1978

[30] Foreign Application Priority Data

Mar. 7, 1977 [JP] Japan ..... 52/026214[U]

[51] Int. Cl.[2] ..... F02B 33/00

[52] U.S. Cl. ..... 123/489; 60/276

[58] Field of Search ..... 123/119 EC, 139 AW, 123/32 EA, 32 EJ; 60/276, 285

[56] References Cited

U.S. PATENT DOCUMENTS

| | | | |
|---|---|---|---|
| 2,980,090 | 4/1961 | Sutton et al. | 123/32 EJ |
| 3,765,380 | 10/1973 | Rachel et al. | 123/32 EJ |
| 3,831,564 | 8/1974 | Schmidt et al. | 60/285 |
| 3,837,321 | 9/1974 | Saner | 123/32 EJ |
| 3,875,907 | 4/1975 | Wessel et al. | 60/276 |
| 3,880,125 | 4/1975 | Kammerer et al. | 123/139 AW |
| 3,926,154 | 12/1975 | Williams | 60/276 |
| 3,927,304 | 12/1975 | Wentworth et al. | 123/32 EC |
| 3,938,075 | 2/1976 | Reddy | 60/285 |
| 3,939,654 | 2/1976 | Creps | 60/276 |
| 3,949,551 | 4/1976 | Eichler et al. | 60/285 |
| 3,980,062 | 9/1976 | Wessel et al. | 123/32 EA |
| 3,983,848 | 10/1976 | Handtmann et al. | 123/32 EA |
| 4,029,061 | 6/1977 | Asano | 60/285 |
| 4,048,964 | 9/1977 | Kissel | 123/32 EA |
| 4,057,042 | 11/1977 | Aono | 123/119 EC |
| 4,077,364 | 3/1978 | Aoki | 60/285 |
| 4,105,000 | 8/1978 | Wessel et al. | 123/139 AW |
| 4,121,545 | 10/1978 | Mizole | 123/32 EJ |
| 4,134,368 | 6/1979 | Hadley | 123/32 EA |

*Primary Examiner*—Charles J. Myhre
*Assistant Examiner*—Raymond A. Nelli
*Attorney, Agent, or Firm*—Stevens, Davis, Miller & Mosher

[57] ABSTRACT

Disclosed is an air-fuel ratio feedback control apparatus for an internal combustion engine. The engine adopts a fuel injection system and the air-fuel ratio control apparatus comprises a specific air flow meter whose output signal indicates a different amount from the actual amount of air flow sucked into the engine, and a feedback control stopping circuit. When the feedback control is stopped, the desirable air-fuel ratio is obtained.

4 Claims, 8 Drawing Figures

AIR-FUEL RATIO CONTROL APPARATUS FOR AN INTERNAL COMBUSTION

BACKGROUND OF THE INVENTION

This invention relates to an air-fuel ratio control apparatus for an internal combustion engine and, particularly, relates to an air-fuel ratio feedback control apparatus for an internal combustion engine comprising a feedback control-stopping circuit.

There is known a system for precisely controlling the air-fuel ratio in the exhaust gas of an internal combustion engine so that it is a stoichiometric air-fuel ratio. That system comprises an air-fuel ratio detector for example, an oxygen concentration detector disposed in an exhaust system of the internal combustion engine, to detect the oxygen concentration in the exhaust gas. In the system a detection signal from the air-fuel ratio detector is fed back to electronic fuel injection control means to correct the amount of fuel injected in the internal combustion engine so as to effect the above air-fuel ratio control. If a three way catalytic converter capable of simultaneously purifying three harmful components, i.e., HC, CO and $NO_x$, were to be combined with this air-fuel ratio feedback control system, it would seem to be possible to obtain a clean exhaust gas. However, since, according to this control system the air-fuel ratio is controlled so that it is the stoichiometric air-fuel ratio throughout the entire operating condition of the internal combustion engine, a problem of overheating of the catalytic converter is caused.

The applicant has already proposed an air-fuel ratio feedback control apparatus for an internal combustion engine, which can solve the above problem. This apparatus comprises a mechanism for detecting the level of intake vacuum in an internal combustion engine and the rotational speed thereof, and a feedback-stopping mechanism arranged so that when the detected vacuum level and rotational speed exceed predetermined levels, correction of the air-fuel ratio by the feedback is stopped and the air-fuel correction signal is maintained at a predetermined value. In this apparatus, however, since there is an error in the control range of stopping the feedback, overheating of the catalytic converter cannot be prevented efficiently and assuredly. In addition to this defect, the previously proposed apparatus has a defect in that a circuit must be provided for maintaining the correction signal at a predetermined value at the time of stopping the feedback control. Still further, the apparatus is defective in that it is difficult to reduce the specific fuel consumption.

SUMMARY OF THE INVENTION

It is, therefore, and object of the present invention to provide an air-fuel ratio feedback control apparatus for an internal combustion engine, in which the feedback control can be accomplished without overheating of an exhaust gas purifying catalytic converter.

Another object of the present invention is to provide an air-fuel ratio feedback control apparatus for an internal combustion engine, in which the rate of fuel consumption can be reduced.

Still another object of the invention is to provide an air-fuel ratio feedback control apparatus for an internal combustion engine, which has a simple circuit structure.

According to the present invention, the air-fuel ratio control apparatus for an internal combustion engine comprises an air-fuel ratio detector disposed in an exhaust system of the engine, for detecting an air-fuel ratio in an exhaust gas, and a feedback circuit, for providing a correction signal based on the detected signal of the air-fuel ratio detector. The air-fuel ratio control apparatus further comprises an air flow meter disposed in an air intake system of the engine. This air flow meter provides an output signal indicating an intake air flow amount which is smaller than an actual intake air flow amount of the engine when the actual air flow amount is smaller than a predetermined amount, and provides an output signal indicating an intake air flow amount which is larger than an actual intake air flow amount of the engine when the actual air flow amount is larger than the predetermined amount. The air-fuel ratio control apparatus still further comprises a rotational speed detector, for providing a signal indicating a rotational speed of the engine, and a control circuit for calculating an amount of fuel which should be injected from the injection valve based on the output signal of the air flow meter, the output signal of the rotational speed detector and the correction signal provided from the feedback circuit. The control circuit controls the injection operation of the injection valve according to the calculated amount of fuel. The air-fuel ratio control apparatus further comprises a circuit for stopping the feedback operation of the feedback circuit when a specific operating condition of the engine is detected. Therefore, when the feedback operation is stopped, a rich air-fuel mixture is fed into a cylinder of the engine when the flow amount of intake air is larger than the predetermined amount, and a lean air-fuel mixture is fed into the cylinder of the engine when the flow amount of intake air is smaller than the predetermined amount.

The above and other related objects and features of the present invention will be apparent from the description set forth below, with reference to the accompanying drawings, and from the appended claims.

In the drawings:

FIG. 1*a* is a characteristic diagram illustrating the relation between the air-fuel ratio and exhaust gas temperature of an internal combustion engine;

FIG. 1*b* is a characteristic diagram illustrating the relation between air-fuel ratio and the rate of fuel consumption of an internal combustion engine;

DETAILED DESCRIPTION

Figure 1A:
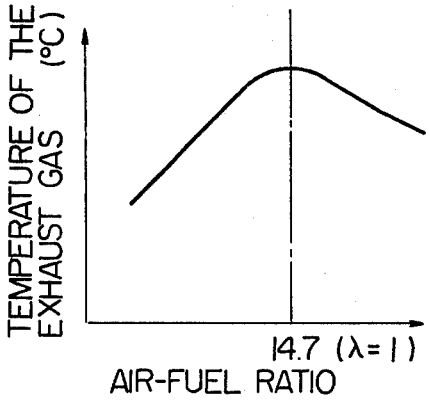
Figure 1B:
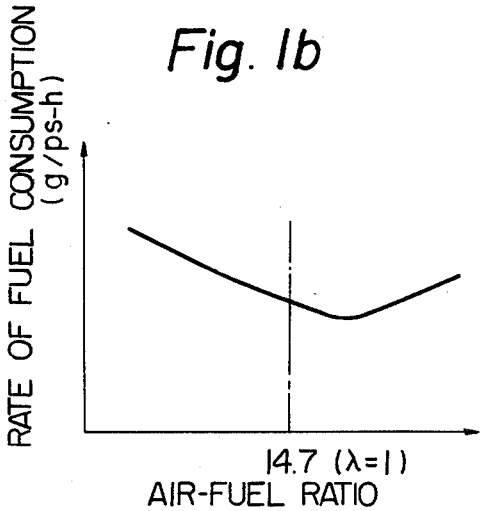

In general, the temperature of the exhaust gas in an internal combustion engine is highest, as shown in FIG. 1-*a*, when the air-fuel ratio approximates the stoichiometric air-fuel ratio. Accordingly, if the air-fuel ratio is always controlled so that it is the stoichiometric air-fuel ratio, in case of heavy-load, high-speed operating or the like of the engine, the temperature of the exhaust system, especially a three way catalytic converter disposed in the exhaust system, is drastically elevated, and the catalytic converter is degraded. Further, as shown in FIG. 1-*b*, the rate of fuel consumption is lowest when the air-fuel ratio in the engine is higher than the stoichiometric air-fuel ratio, namely when the air-fuel mixture is lean.

Accordingly, it is necessary to stop the feedback control of the air-fuel ratio and to control the amount of the injected fuel so as to adjust the air-fuel ratio in a specific operating region of the internal combustion engine to a level leaner or richer than the stoichiometric air-fuel ratio.

Figure 2:
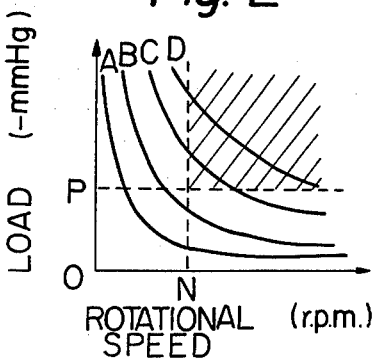
FIG. 2 is a characteristic diagram illustrating the relation between rotational speed and load of an internal combustion engine.

According to the conventional technique proposed previously by the applicant, the operating region in which the air-fuel mixture to be supplied to the internal combustion engine is made richer, namely the operating region in which the air-fuel ratio feedback control is stopped and the air-fuel ratio is maintained at a certain level lower than the stoichiometric air-fuel ratio, is set by the logical product of a signal indicating the load on the internal combustion engine and a signal indicating the rotational speed thereof. Accordingly, the operating region in which the air-fuel ratio feedback control is stopped in the above-mentioned conventional apparatus is a region hatched in FIG. 2. However, the flow amount of intake air sucked in to the engine, which practically defines the temperature of the catalytic converter in the exhaust system, is represented by the product of a signal indicating the load on the engine and a signal indicating the rotational speed thereof, and hence, when the flow amount of intake air is constant, the load level is inversely proportional to the rotation speed, as shown by curves A, B, C and D in FIG. 2. Curves A, B, C and D show results obtained in cases where the flow amount of intake air is gradually increased. The operating region in which the air-fuel ratio feedback control must be stopped is located above such curves. As will be apparent from FIG. 2, according to the conventional technique, the operating region in which the air-fuel ratio feedback control is stopped is not in agreement with the operating region in which the stop of this control is actually desired. Accordingly, as pointed out hereinbefore, according to the conventional technique, it is difficult to reduce the rate of fuel consumption and it is impossible to prevent overheating of the catalytic converter efficiently.

Figure 3:
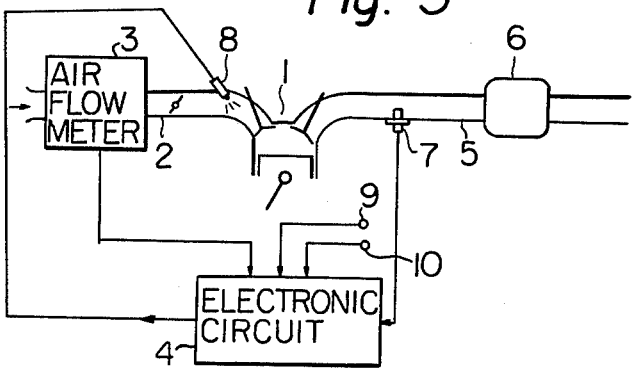
FIG. 3 is a view illustrating diagrammatically the entire arrangement of the air-fuel ratio control apparatus for an internal combustion engine of the fuel injection type according to the present invention.

FIG. 3 is a view illustrating diagrammatically the air-fuel ratio control apparatus for an internal combustion engine of the fuel injection electronic control type according to the present invention. As shown in FIG. 3, an air flow meter 3 is disposed in an intake system of an internal combustion engine 1 to measure the flow amount of air sucked into the internal combustion engine. The output of the air flow meter 3 is electrically connected to an electronic circuit 4. A three way catalytic converter 6 for purifying harmful exhaust gas components and an air-fuel ratio detector 7, for example, an oxygen concentration detector for detecting the oxygen concentration in the exhaust gas, are disposed in an exhaust system 5 of the internal combustion engine 1. The output of the air-fuel ratio detector 7 is electrically connected to the electronic circuit 4. An electromagnetic fuel injection valve 8 is disposed upstream of an intake valve of the engine 1 and a solenoid for actuating the injection valve 8 is electrically connected to the output of the electronic circuit 4. The electronic circuit 4 comprised input terminals 9 and 10, to which a signal indicating the rotational speed of the engine 1 and a detection signal of the cooling water temperature are fed.

Figure 4:
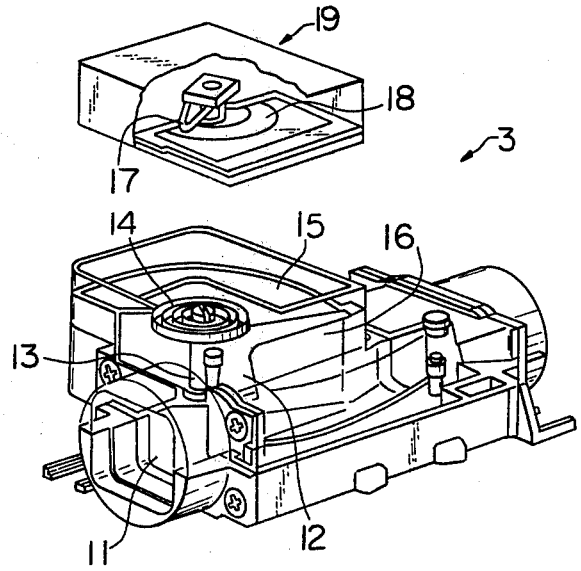
FIG. 4 is a perspective view of an air flow meter.
Figure 5:
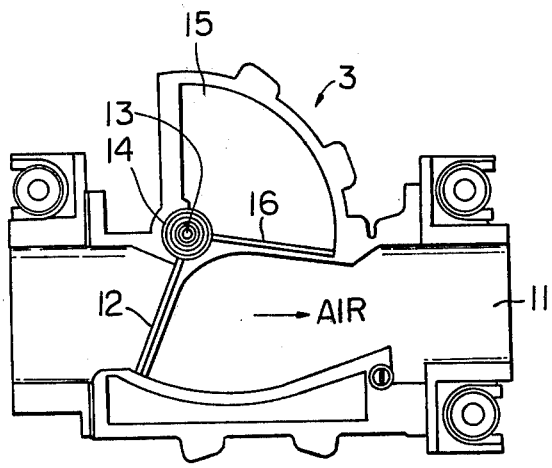
FIG. 5 is a sectional view of the air flow meter.

This electronic circuit 4 calculates a pulse width of a basic pulse for fuel injection based on a signal indicating the amount of air sucked into the engine, which is fed from the air flow meter 3, a signal indicating the rotational speed of the engine and a signal indicating the temperature of the cooling water in the engine, and then, the electronic circuit 4 provides an infection pulse formed by correcting said pulse width of said basic fuel injection pulse according to a signal from the air-fuel ratio detector 7 to the fuel injection valves 8. As shown in FIGS. 4 and 5 , the air flow meter 3 has an intake air passage 11 in the interior of a housing thereof, and a flow measuring plate 12 is disposed in the intake air passage 11. The flow measuring plate 12 is fixed to a rotation shaft 13 supported rotatably on the housing. A spiral spring 14 is mounted between the rotation shaft 13 and the housing, and the flow measuring plate 12 is always urged in the clockwise direction in FIG. 5 by the force of the spiral spring 14. A damper chamber 15 is formed in the housing, and a damper plate 16 integrated with the flow measuring plate 12 is disposed in the damper chamber 15. As shown in FIG. 4, the air flow meter 3 further comprises a potentiometer 19 including a rotary sliding member 17 and a fixed sliding resistance 18. The rotary sliding member 17 is connected to the top end portion of the rotation shaft 13. When sucked air flows in the intake air passage 12 in the direction of the arrow, the flow measuring plate 12 is turned an amount in the counterclockwise direction in FIG. 5 depending on the amount of sucked air, and also, the sliding member 17 is turned with the turning movement of the flow measuring plate 12, whereby the value of the output resistance in the potentiometer 19 is changed.

Figure 6:
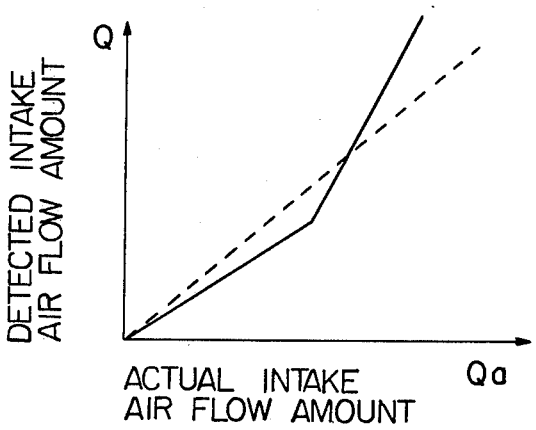
FIG. 6 is a characteristic diagram illustrating the relation between the actual intake air flow amount and the intake air flow amount detected by the air flow meter.

In the conventional air flow meter, as indicated by a broken line in FIG. 6, the resistance 18 is arranged so that the detected intake air flow amount Q accurately indicates the actual intake air flow amount Qa. However, according to the present invention as indicated by a solid line in FIG. 6 the resistance 18 is arranged so that when the actual intake air flow amount is smaller than a predetemined amount, the intake air flow amount Q detected by the air flow meter 3 is a value smaller than the actual intake air flow amount Qa. Furthermore, the resistance 18 is arranged so that when the actual intake air flow amount is larger than the predetermined amount, the intake air flow amount Q detected by the air flow meter 3 is a value larger than the actual intake air flow amount Qa. When this arrangement is adopted, for example, when the actual intake flow amount Qa is smallerr than the predetermined amount, the air flow amount detection signal fed to the electronic circuit 4 (see FIG. 3) from the air flow meter 3 gives an indication as if air were sucked in a flow amount smaller than the actual intake air flow amount.

The intake air flow meter that is used in the present invention is not limited to one having the above-mentioned structure. For example, in the present invention an electric signal conversion circuit capable of attaining characteristics as shown by the solid line in FIG. 6 may be attached to the output side of the conventional intake air flow meter, so that the air flow amount detection signal is converted and controlled by this circuit.

Figure 7:
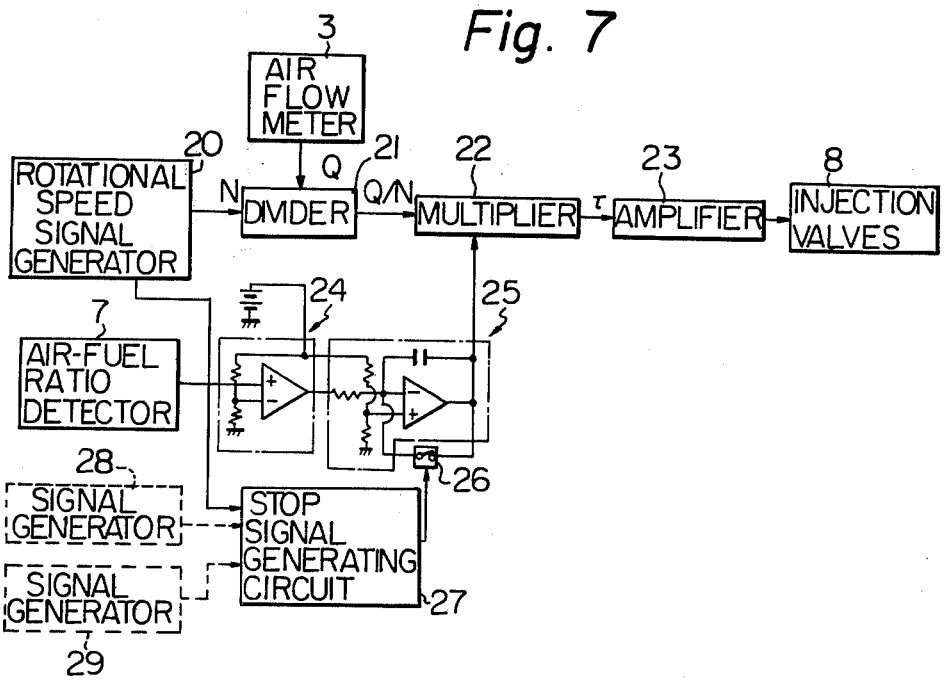
FIG. 7 is a circuit diagram of an electronic circuit according to the present invention.

Referring now to FIG. 7, reference numeral 21 represents a divider to which inputs of a rotational speed signal generator 20 generating a signal indicating the rotational speed of the internal combustion engine and of the air flow meter 3 are connected. This divider 21 receives the rotational speed signal N from the rotation speed signal generator 20 and the intake air flow amount Q provided from the air flow meter 3, and calculates the amount of air sucked per cycle of the engine, i.e., Q/N. The output of the divider 21 is connected to one input of a multiplier 22 and the output of the multiplier is connected to the fuel injection valves 8 through an amplifier 23. When the output signal of the divider 21 is applied to the multiplier 22, it generates a pulse signal having a pulse width $\tau$, which defines the amount of the fuel to be injected, and this pulse signal is amplified by the amplifier 23 and is then applied to the fuel injection valves 8 to open them and effect injection of the fuel.

The air-fuel ratio detector 7 is for example an oxygen concentration detector composed of $ZrO_2$ ceramics. This detector 7 generates an output of about 0.1 V when the exhaust gas is an oxidizing atmosphere and it generates an output of about 0.9 V when the exhaust gas is a reducing atmosphere. The output of the air-fuel ratio detector 7 is connected to one input of a comparator 24, and reference voltage is supplied to the other input of the comparator 24. The output of the comparator 24 is connected to the other input of the multiplier 22 through an integrator 25, and a switch 26 formed of a semiconductor or the like is connected to the integrator 25 to stop the integrating operation. For example, as shown in FIG. 7, this switch 26 is inserted between an inverting input terminal and an output terminal of an operational amplifier in the integrator 25, and it is normally opened. The control terminal of this switch 26 is connected to the output of a stop signal generating circuit 27, which generates a signal for stopping the feedback control. The rotational speed signal generator 20 and a signal generator 28, for generating a signal indicating the speed of a vehicle or the like driven by the internal combustion engine, or a signal generator 29 for generating a signal indicating the shift position of a transmission gear of the vehicle, are connected to the input of the stop signal generating circuit 27.

When the engine is in the high speed operating condition, namely the rotational speed signal or the vehicle speed signal exceeds a predetermined lever, and/or when a predetermined shift position signal of a transmission gear of the engine is applied, the stop signal generating circuit 27 generates a stop signal. When this stop signal is applied to the control terminal of the switch 26, the switch 26 is closed.

The operation of the control apparatus of the present invention will now be described by reference to the case where the feedback control is conducted.

When the exhaust gas of the engine is a reducing atmosphere, namely when an air-fuel mixture sucked into the engine is rich, a voltage signal appears on the output terminal of the comparator 24 by the actions of the air-fuel ratio detector 7 and comparator 24. This voltage signal is integrated in the integrator 25, and the integrated output voltage is a signal voltage of which the intensity is reduced with the lapse of time. This integrated output voltage is fed to the multiplier 22, and in the multiplier 22, the pulse width of the pulse signal Q/N fed from the divider 21 is controlled depending on this integrated output voltage. More specifically, when the air-fuel ratio of an air-fuel mixture fed into the cylinder of the engine is lower than the stoichiometric air-fuel ratio (the mixture is rich), the pulse width is narrowed, and when the air-fuel ratio is higher than stoichiometric air-fuel ratio (the mixture is lean), the pulse width is broadened. As a result, the pulse width $\tau$ of the fuel injection pulse is feedback-controlled so that the air-fuel ratio of the air-fuel mixture is always adjusted to the stoichiometric air-fuel ratio.

The high speed operating condition of the engine, i.e., the rotational speed exceeding the predetermined level, or the vehicle speed exceeding the predetermined value, or shifting of the transmission gear to the predetermined position, is detected by the signal generating circuit 27, and when the stop signal is emitted on detection, the switch 26 is closed to stop the integrating operation of the integrator 25. As a result, the feedback control of the air-fuel ratio by the signal from the air-fuel ratio detector 7 is stopped. In this case, the amount of the fuel injected from the fuel injection valves 8 is controlled by the detection signal provided from the air flow meter 3.

As pointed out hereinbefore, the detection signal of the air flow meter 3 indicates an air amount smaller than the actual intake air flow amount when the actual intake air flow amount is smaller than the predetermined amount, and it indicates an air amount larger than the actual intake air flow amount when the actual intake air flow amount is larger than the predetermined amount. Accordingly, when the actual intake air flow amount is smaller than the predetermined amount, the amount of the fuel injected to intake air is reduced, and a lean air-fuel mixture is fed into the cylinder of the engine. On the other hand, when the actual intake air flow amount is larger than the predetermined amount, the amount of the fuel injected to intake air is increased, and a rich air-fuel mixture is fed into the cylinder of the engine.

When the engine is in the high speed operating condition and the load of the engine is low, the actual intake air flow amount is smaller that the predetermined amount, and a lean air-fuel mixture is fed into the cylinder of the engine. As a result, as pointed out hereinbefore (FIG. 1-*a*), the temperature of the catalytic converter is lowered, and since the air-fuel mixture is lean, the contents of pollutants, HC, CO and $NO_x$, in the exhaust gas are lowered and the rate of fuel consumption is reduced (see FIG. 1-*b*). On the other hand, when the engine is in the high speed operating condition and the load is heavy, since the actual intake air flow amount is larger than the predetermined amount, a rich air-fuel mixture is fed into the cylinder of the engine. As a result, the temperature of the catalytic converter is lowered and a high power output can be obtained.

As will be apparent from the foregoing description, according to the present invention, the circuit structure can be simplified because a correction signal retention circuit for fixing the air-fuel ratio to the rich or lean side at the time of stopping the feedback control of the air-fuel ratio need not be particularly provided. Further, according to the present invention, the air-fuel ratio can be controlled depending on the load on the engine, i.e., the intake air flow amount, even at the time of stopping the feedback control of the air-fuel ratio, and the rate of fuel consumption can be reduced. Still further, according to the present invention, overheating of the three way catalytic converter can be prevented assuredly.

As many widely different embodiments of the present invention may be effected without departing from the spirit and scope of the present invention, it should be understood that the invention is not limited to the specific embodiment described in this specification, except as defined in the appended claims.

What is claimed is:

1. An air-fuel ratio control apparatus for an internal combustion engine having an air intake system, an exhaust system, and at least one fuel injection valve in said air intake system, said apparatus comprising:

an air-fuel ratio detector in said exhaust system of said engine for detecting the air-fuel ratio of the exhaust gas;

a feedback circuit for generating a correction signal in accordance with said detected signal of said air-fuel ratio detector, said feedback circuit comprising a comparator for comparing a voltage of said detected signal of said air-fuel ratio detector with a reference voltage, and an integrator for integrating an output signal of said comparator;

an air flow meter in said air intake system for generating an air flow amount signal indicating an intake air flow amount which is smaller than the acutal intake air flow amount of the engine when the actual air flow amount is smaller than a predetermined amount, and for generating an air flow amount signal indicating an intake flow amount which is larger than the actual intake air flow amount of the engine when the actual air flow amount is larger than said predetermined amount;

a rotational speed detector for generating a speed signal indicating the rotational speed of said engine;

a circuit for stopping the feedback operation of said feedback circuit so as to maintain the level of said correction signal at a predetermined level when the speed signal indicates that the rotational speed of the engine exceeds a predetermined value, said stopping circuit comprising a switch means in said integrator which is actuated when the speed signal indicates that the rotational speed of the engine exceeds a predetermined value so that an integration operation is stopped and the correction signal having said predetermined level is generated from said feedback circuit; and a control circuit for calculating an amount of fuel to be injected from said injection valve into said engine by using said air flow amount signal, said speed signal, and said correction signal, and for controlling the injection operation of said injection valve in accordance with said calculated amount of fuel.

2. An air-fuel ratio control apparatus as claimed in claim 1, wherein said control circuit comprises a first circuit for calculating a basic injection amount of fuel based on said air flow amount signal and said speed signal, and a second circuit for correcting said basic injection amount of fuel by said correction signal.

3. An air-fuel ratio control apparatus as claimed in claim 2, wherein said first circuit is a divider for calculating an amount of air flow sucked per cycle of said engine.

4. An air-fuel ratio control apparatus as claimed in claim 2, wherein said second circuit is a multiplier.

* * * * *

UNITED STATES PATENT AND TRADEMARK OFFICE

CERTIFICATE OF CORRECTION

PATENT NO. : 4,210,114

DATED : July 1, 1980

INVENTOR(S) : Haruo WATANABE

It is certified that error appears in the above-identified patent and that said Letters Patent are hereby corrected as shown below:

In the Title, Item [54], should read -- AIR-FUEL RATIO CONTROL APPARATUS FOR AN INTERNAL COMBUSTION ENGINE --.

Signed and Sealed this

*Nineteenth* Day of *August 1980*

[SEAL]

*Attest:*

SIDNEY A. DIAMOND

*Attesting Officer*

*Commissioner of Patents and Trademarks*